US007762284B2

(12) United States Patent
Ricks

(10) Patent No.: US 7,762,284 B2
(45) Date of Patent: Jul. 27, 2010

(54) RICKS BEADING LOOM

(76) Inventor: Paul Cuthbert Ricks, 16625 Forest Green Ter., Elbert, CO (US) 80106

( * ) Notice: Subject to any disclaimer, the term of this patent is extended or adjusted under 35 U.S.C. 154(b) by 70 days.

(21) Appl. No.: 12/283,964

(22) Filed: Sep. 18, 2008

(65) Prior Publication Data

US 2010/0065590 A1 Mar. 18, 2010

(51) Int. Cl.
*D03D 29/00* (2006.01)
*D03D 41/00* (2006.01)

(52) U.S. Cl. ..... 139/29; 223/48

(58) Field of Classification Search ..... 139/1 R, 139/11, 29, 33, 33.5, 34; 223/48
See application file for complete search history.

(56) References Cited

U.S. PATENT DOCUMENTS

| | | | | | |
|---|---|---|---|---|---|
| 538,022 | A * | 4/1895 | Lapworth | 139/199 |
| 737,073 | A * | 8/1903 | Bush | 28/151 |
| 2,094,505 | A * | 9/1937 | Thackeray | 139/33 |
| 2,139,879 | A * | 12/1938 | Clark | 139/33 |
| 2,150,187 | A * | 3/1939 | Raba et al. | 139/33 |
| 2,241,318 | A * | 5/1941 | Robson | 139/33 |
| 2,346,541 | A * | 4/1944 | Owen et al. | 139/33 |
| 2,414,663 | A * | 1/1947 | Parton | 139/33 |
| 2,504,940 | A * | 4/1950 | Wallach | 28/151 |
| 2,641,389 | A * | 6/1953 | Bagdon | 223/48 |
| 2,670,109 | A * | 2/1954 | Perry et al. | 223/48 |
| 2,691,203 | A * | 10/1954 | Wilder | 28/149 |
| 2,780,854 | A * | 2/1957 | Dritz | 28/152 |
| 2,802,255 | A * | 8/1957 | Wallach | 28/151 |
| 2,885,130 | A * | 5/1959 | Spool | 223/48 |
| 3,636,987 | A * | 1/1972 | Forby | 28/151 |
| 3,724,041 | A * | 4/1973 | Cleverley | 28/149 |
| 3,800,372 | A * | 4/1974 | Daoust | 28/152 |
| 3,804,127 | A * | 4/1974 | Roland | 28/151 |
| 3,879,823 | A * | 4/1975 | Lamb | 28/147 |
| 3,996,969 | A * | 12/1976 | McCullough et al. | 139/29 |
| 4,046,171 | A * | 9/1977 | Wilson | 139/29 |
| 4,154,267 | A * | 5/1979 | Orr et al. | 139/29 |
| 4,160,467 | A * | 7/1979 | Woodruff | 139/33 |
| 4,181,158 | A * | 1/1980 | Kidd | 139/33 |
| 4,582,096 | A * | 4/1986 | Louet | 139/29 |
| 4,832,085 | A * | 5/1989 | Northrup | 139/34 |
| 6,065,504 | A * | 5/2000 | Sidore | 139/29 |
| 6,719,013 | B1 * | 4/2004 | D'Estais | 139/29 |
| 7,147,008 | B2 * | 12/2006 | Sayler | 139/29 |
| 2006/0157137 | A1 * | 7/2006 | Sayler | 139/29 |
| 2008/0173368 | A1 * | 7/2008 | Flodin et al. | 139/33 |

* cited by examiner

*Primary Examiner*—Bobby H Muromoto, Jr.
(74) *Attorney, Agent, or Firm*—Nancy Lord

(57) ABSTRACT

A new and unique innovation in the art of bead weaving on a loom by eliminating the numerous remaining ends of the warp threads which, in other methods, must be woven back into the finished project. The innovation results in having only two remaining warp threads instead of many. The innovation also provides a new method for adjustment of the project length through the use of a "floating" rear vertical upright tailstock.

5 Claims, 7 Drawing Sheets

Side view without warp thread attached

LEGEND
1. Front Vertical Upright (Headstock)
2. Wooden Thread Attachment Peg (3 typical)
3. Warp rods
4. Rear Vertical Upright (Tailstock)
5. Attachment Cleats
6. Base (Bed)
6a. Screw Eye(s)

Side view without warp thread attached

LEGEND
1. Front Vertical Upright (Headstock)
2. Wooden Thread Attachment Peg (3 typical)
3. Warp rods
4. Rear Vertical Upright (Tailstock)
5. Attachment Cleats
6. Base (Bed)
6a. Screw Eye(s)

Front view without warp thread attached

LEGEND
7. Front Vertical Upright (Headstock)
8. Warp Rods in place
9. Wooden Peg insertion holes (5 typical)
10. Wooden thread attachment pegs (3 typical)
6a. Screw Eye Top View without warp thread attached LEGEND:
11. Front Vertical Upright (Headstock)
12. Wooden Dowel Guide Rods
13. Central Threaded Adjustment Rod
14. Locking Wing Nut (2 typical, one hidden in this view)
15. Rare Earth Magnets
6a. Screw Eye(s)

Back View without warp thread attached

LEGEND
16. Rear Vertical Upright (Tailstock)
17. Wooden Peg insertion holes (5 typical)
18. Rear Locking Wing Nut
6a. Screw Eye Side View WITH warp thread attached LEGEND
19. Front Vertical Upright (Headstock)
20. Warp Thread Attached to wooden peg
21. Warp Thread wrapped around Warp Rods
22. Warp Rods
6a. Screw Eye(s)

Front View with warp thread attached

LEGEND
23. Front Vertical Upright (Headstock)
24. Wooden Thread attachment pegs (3 typical)
25. Warp Rods
26. Warp Thread attached to wooden thread attachment pegs
6a. Screw Eye Top View with warp thread attached LEGEND
27. Warp threads wrapped around warp rods
28. Rare Earth magnets
6a. Screw Eye(s)

RICKS BEADING LOOM

CROSS-REFERENCE TO RELATED APPLICATIONS

Not Applicable

STATEMENT REGARDING FEDERALLY SPONSORED RESEARCH OR DEVELOPMENT

Not Applicable

NAMES OF PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of Invention

The general field of the invention is hand crafted beaded jewelry, and more specifically, the crafting of these projects on a loom. The general mode of operation of a beading loom is well known to practitioners of the art and is described below.

2. Background Art

In the general construction of a loomed beaded jewelry item, a series of separate threads are attached to each end of the loom longitudinally to form a beading surface. These longitudinal threads are referred to as "warp threads". The number of warp threads attached is dependant upon the number of beads in a single row of the project to be crafted. There is always one more warp thread than the number of beads in that single row, i.e. if the there are 18 beads in a single row of the project to be crafted, there must be 19 warp threads attached.

An additional thread is then attached to the front area of the loom and a needle is threaded onto the other end of this thread. This thread is referred to as the "weft thread" (or, informally—the "beading thread".) All of the beads in a single row are strung onto the weft thread which is then passed underneath the warp threads. Each bead is then pressed up into the spaces between the warp threads (one bead into each space). The needle is then passed back in the opposite direction through the holes in the beads and over the warp threads, thereby securing the beads to the warp threads. This process is then repeated the number of times necessary to reach the desired length of the project.

Upon completion of the project, the project is removed from the loom. The remaining ends of the warp threads (19 on each end—for a total of 38 threads in this example) must then be hand woven back into the project in order not to be visible in the final product. This is a difficult and time consuming process which deters many people from engaging in this craft art.

This invention solves the specific problem of having the remaining ends of the warp threads and does not require that they be woven back into the project.

BRIEF SUMMARY OF THE INVENTION

This invention is a device, essentially rectangular in shape, designed to enable people to create loomed beadwork craft projects without an excess number of warp threads remaining after completion of the project. The device is fully adjustable from 2 inches through 12 inches without disassembly. It consists of removable "warp rods" which hold the longitudinal warp threads. After project completion, through the use of these warp rods only two threads remain to be woven back into the project, thereby solving the problem of having to weave the many remaining ends of the warp threads back into the project as referred to above.

BRIEF DESCRIPTION OF THE SEVERAL VIEWS OF THE DRAWING

Below is a list of the 7 views of the drawings of the invention and a description of each view.

DETAILED DESCRIPTION OF THE INVENTION

Figure 1:
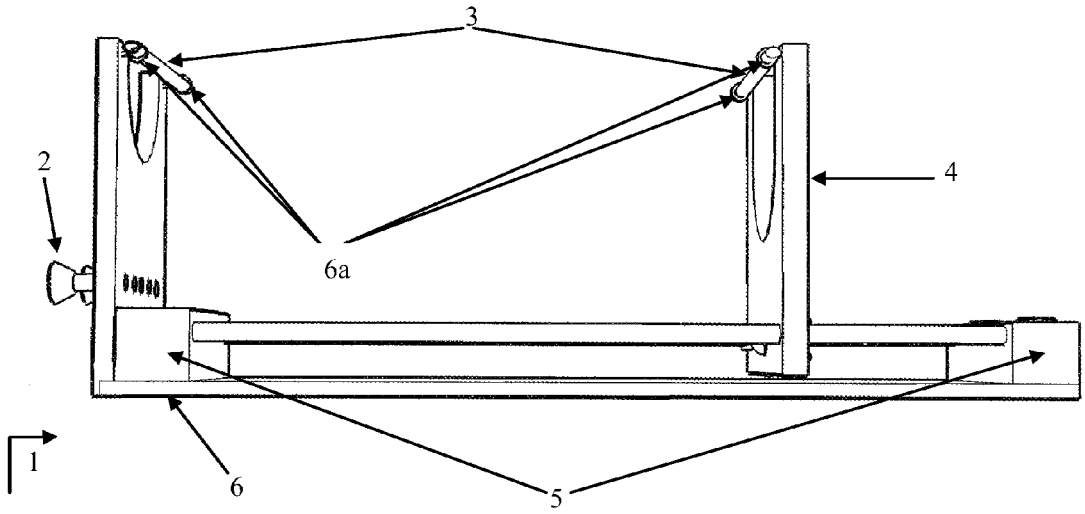
FIG. 1: Side view of the invention without warp thread attached
Figure 2:
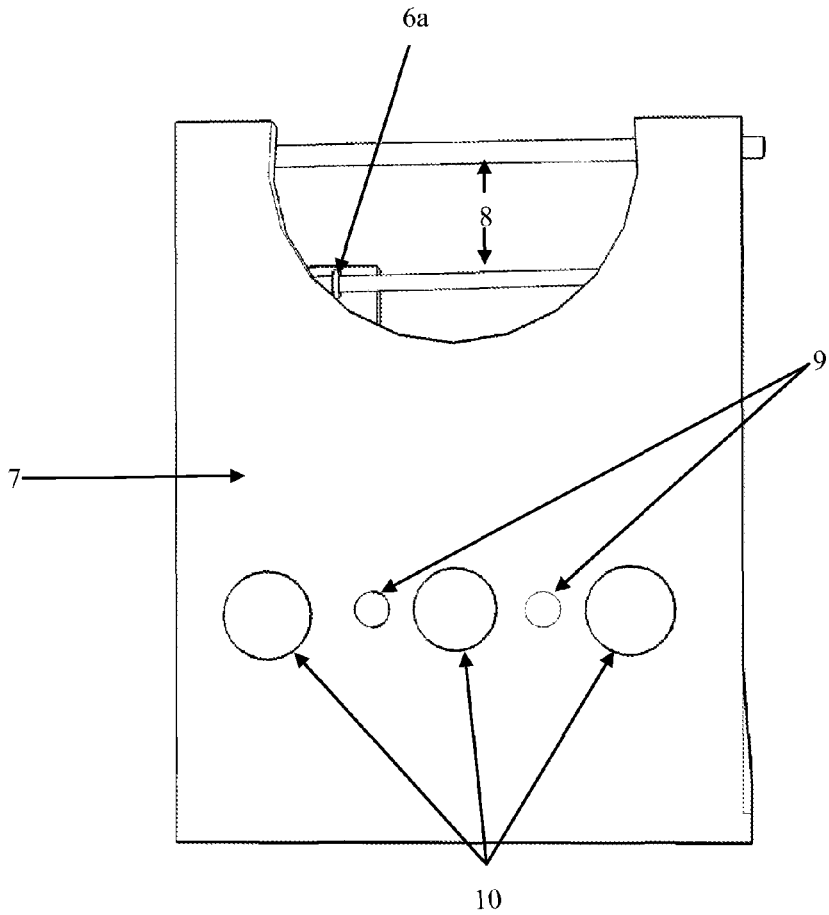
FIG. 2: Front view of the invention without warp thread attached
Figure 3:
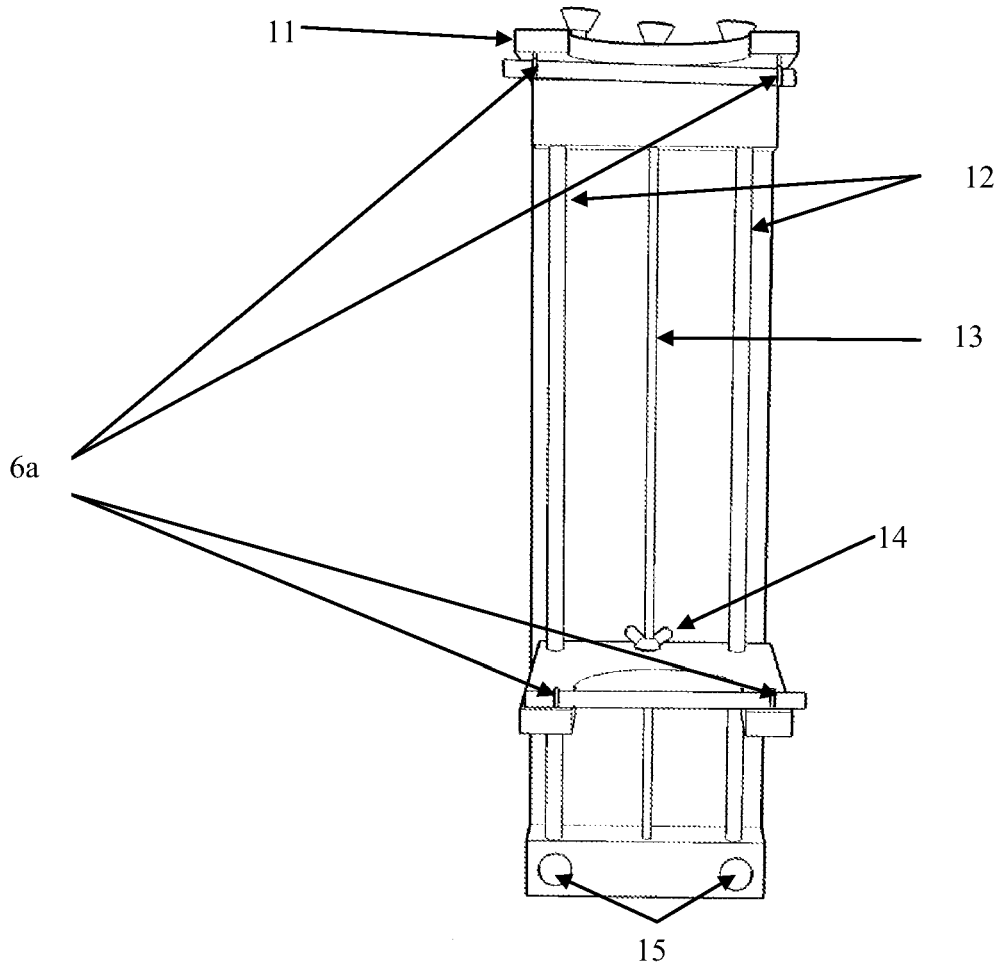
FIG. 3: Top view of the invention without warp thread attached
Figure 4:
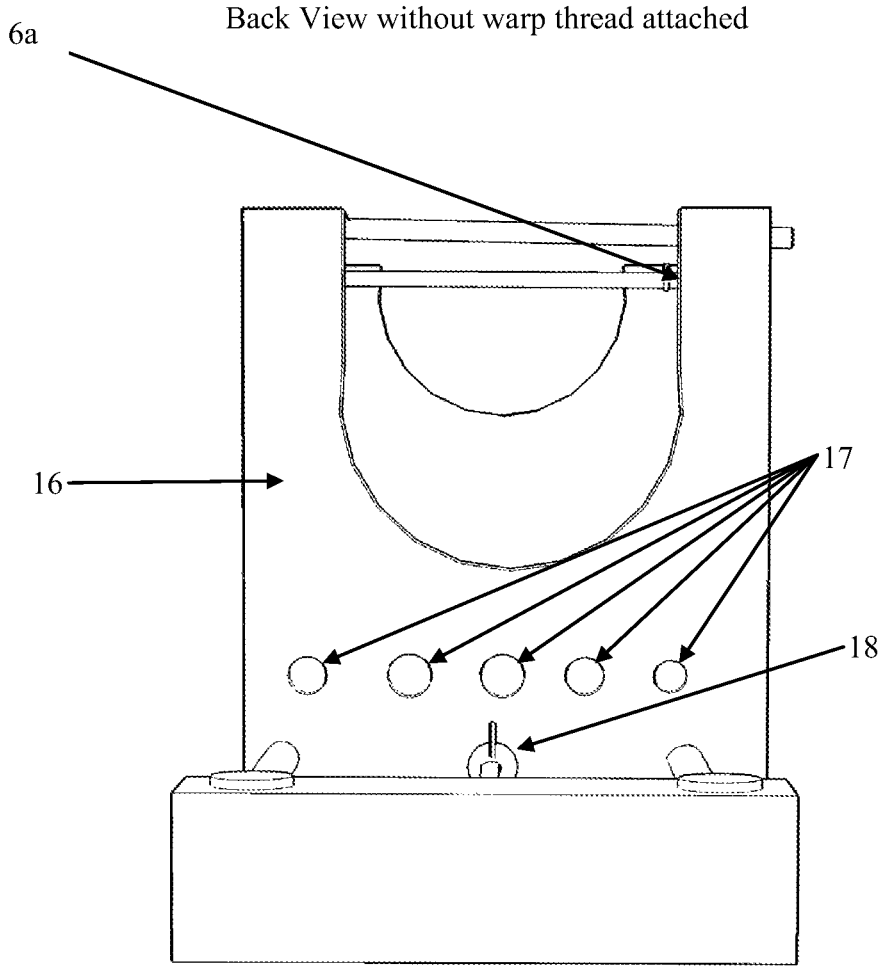
FIG. 4: Back view of the invention without warp thread attached
Figure 5:
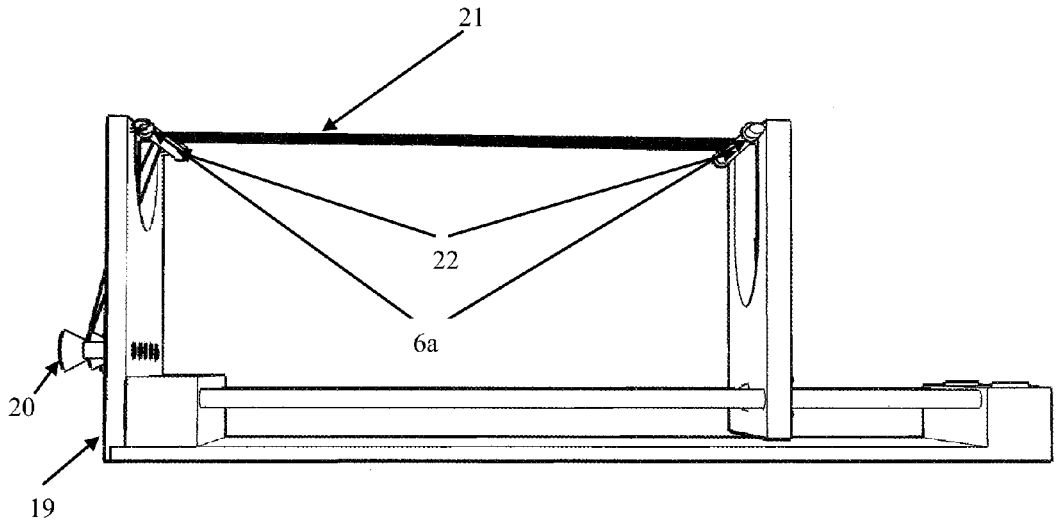
FIG. 5: Side view of the invention WITH warp thread attached
Figure 6:
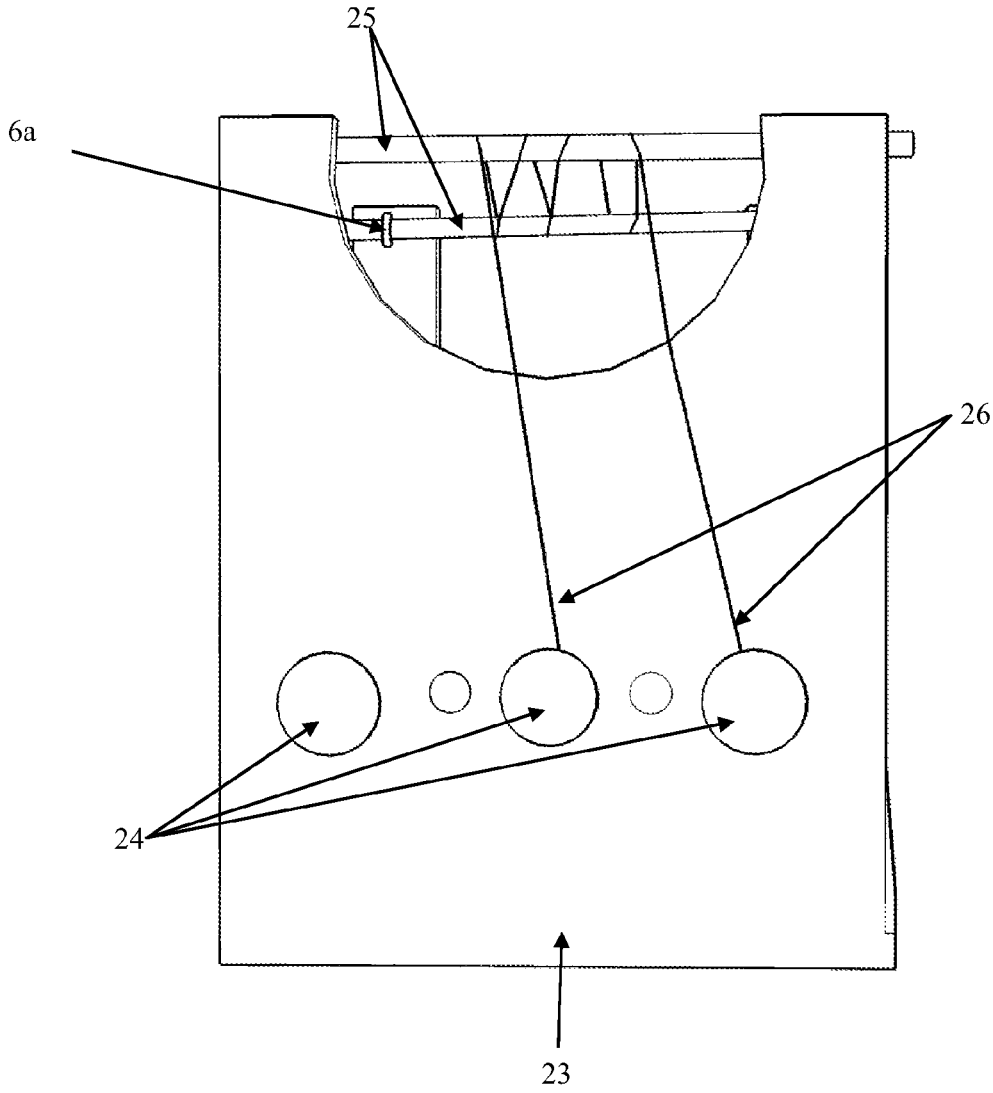
FIG. 6: Front view of the invention with warp thread attached
Figure 7:
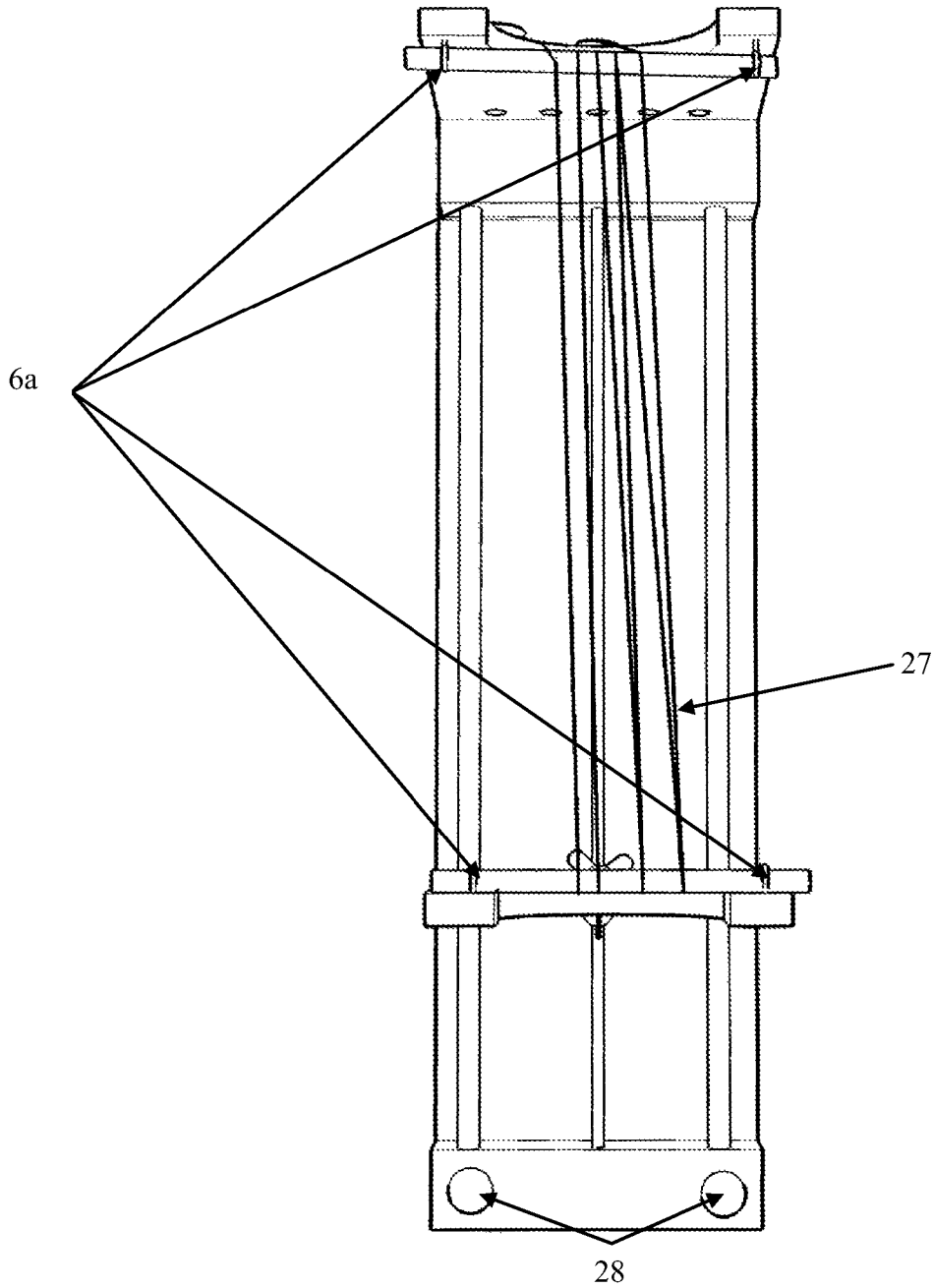
FIG. 7: Top view of the invention with warp thread attached

This invention is a new and unique device to facilitate the construction of beaded craft projects on a loom utilizing a method much easier and simpler than the traditional method.

This device comprises a rectangular base (or "bed") 14 inches long, 3¾ inches wide and ⅜" of an inch in thickness. Upon the bed, 2 cleats, each 3¾ inches long, 1 inch high and ¾ of an inch in width, are mounted latitudinally, one on each end.

These cleats support two wooden dowels (¼" in diameter), one on each end of the cleat and further support one centrally located threaded metal rod (10/24 thread).

A fixed vertical upright 5½ inches in height, 3¾ inches in width, ⅜ inch thick is mounted on the front of the bed, attached to the front cleat. This front vertical upright (referred to hereafter as "the headstock") contains five centrally located holes 5/32" in diameter. These holes are for the insertion of three wooden pegs for holding thread securely in place. These wooden pegs and their purpose are discussed further below.

This headstock further has two small screw eyes mounted on the upper inside surface for the purpose of holding a removable metal rod 5 inches in length and 0.055 inch in diameter. This metal rod is referred to as a "warp rod". These metal rods and their purpose are discussed further below.

A second vertical upright (referred to hereafter as "the tailstock") 4½ inches in height, 3¾ in width and ⅜ inch thick is mounted on the above mentioned two wooden dowels and the central threaded rod in such a manner as to allow it to slide the length of the wooden dowels for adjustment purposes and, when in the desired position, to be locked into place by two wing nuts on the central threaded rod (one on each side of the adjustable vertical upright.) This tailstock contains five centrally located holes 5/32" in diameter. These holes are for the insertion of three wooden pegs for holding thread securely in place. These wooden pegs and their purpose are discussed further below.

This tailstock further has two small screw eyes mounted on the upper inside surface for the purpose of holding a removable metal rod 5 inches in length and 0.055 inch in diameter. This metal rod is referred to as a "warp rod". These metal rods and their purpose are discussed further below.

Three wooden pegs, each approx. 2 inches in length and 5/32 inch in diameter, are inserted into holes in the headstock (or tailstock, dependant upon the number of beads in one row of the crafted bead project) to secure the two ends of the "warp thread" and the single end of the "weft thread".

Two smooth surfaced metal rods (referred to hereafter as "warp rods"), each 5 inches in length and 0.055 inch in diameter are mounted, one each through the screw eyes on the headstock and tailstock. These metal rods support the warp threads which are wound from front to back the requisite number of times again dependant upon the number of beads in one row of the crafted bead project.

Two circular rare earth magnets, each measuring 3/8 inch in diameter and 1/8 inch thick, are mounted on the top surface of the rear cleat to securely store the warp rods when they are not in use.

This invention is constructed entirely of hardwood (with the exception of the central threaded rod, the wing nuts, the screw eyes and the metal warp rods) and can be easily fabricated by anyone who is a serious hobbyist in the woodworking field and these hobbyists would possess the requisite skills and tools (power saw, router, sander, etc.)

Through the use of this invention the art of creating loomed craft jewelry is made much easier and enjoyable to those persons desiring to create these objects, through the use of a single warp thread which is wound in a continuous fashion around the warp rods. This eliminates the use of a separate thread for each warp and also eliminates the remaining ends of the warp threads having to be woven back into the finished project.

Upon completion of a loomed project using this invention, the project is removed from the loom and only the two ends of the single warp thread remain to be woven back into the fabric of the project, regardless of the number beads in a single row of the project thereby making the process much easier and more enjoyable for the person creating the crafted project.

The invention claimed is:

1. A beading loom eliminating the use of a separate thread for each warp whose remaining ends having to be woven back into the finished project and being adjustable in length comprising:

a) a rectangular bed having a length, width, and thickness;

b) two cleats, a front cleat and a back cleat, mounted latitudinally to each longitudinal end, each having a length of the width of said rectangular base, a height, and a width;

c) two wooden dowels having a diameter supported by said cleats one at each end of said cleat;

d) one centrally located threaded metal rod supported by said cleats;

e) a fixed first vertical upright headstock mounted to the front of said base having a height, width, and thickness and attached to said front cleats and containing five centrally located holes having diameters, and having an outer and inner surface;

f) two small screw eyes mounted on the upper inside surface of said headstock;

g) a removable metal warp rod having a length removably attached to said two small screw eyes;

h) a second vertical upright tailstock having a height, width and thickness and containing five centrally located holes having diameters, that is adjustably mounted to said two wooden dowels and said central threaded rod in such a manner as to allow it to slide the length of said wooden dowels for adjustment purposes and, when in the desired position, to be locked into place by two wing nuts mounted on each side of said adjustable vertical upright headstock;

i) two small screw eyes mounted on the upper inside surface of said tailstock for the purpose of holding a removable metal warp rod having a length and a diameter;

j) a second smooth surfaced metal warp rod having a length and a diameter mounted through said screw eyes of said tailstock;

k) three wooden pegs removably inserted into the said holes from the exterior surface of either said headstock or said tailstock to secure the two ends of the "warp thread" and the single end of the "weft thread".

2. The beading loom of claim 1 further comprising two circular rare earth magnets mounted on the top surface of the rear cleat to securely store the warp rods when they are not in use.

3. A beading loom eliminating the use of a separate thread for each warp whose remaining ends having to be woven back into the finished project comprising:

a) a rectangular bed 14 inches long, 3¾ inches wide and 3/8" of an inch in thickness;

b) two cleats, a front cleat and a back cleat, mounted latitudinally to each longitudinal end, each having a length of the width of said rectangular base, each 3¾ inches long, 1 inch high and ¾ of an inch in width;

c) two wooden dowels having a diameter of ¼ inch supported by said cleats one at each end of said cleat;

d) one fixed centrally located threaded metal warp rod 5 inches in length, 0.055 inch in diameter and 10/24 thread, supported by said cleats;

e) a fixed vertical upright headstock 5½ inches in height, 3¾ inches in width, 3/8 inch thick is mounted on the front of the bed, attached to the front cleat, containing five centrally located holes 5/32" in diameter, and having an inner and outer surface;

f) two small screw eyes mounted on the upper inside surface of said headstock;

g) a first removable metal warp rod having a length removably attached to said two small screw eyes;

h) a vertical upright tailstock 4½ inches in height, 3¾ in width and 3/8 inch thick, having five centrally located holes 5/32 inches in diameter, adjustably mounted to said two wooden dowels and said central threaded rod in such a manner as to allow it to slide the length of the wooden dowels for adjustment purposes and, when in the desired position, to be locked into place by two wing nuts mounted on each side of said adjustable vertical upright headstock;

i) two small screw eyes mounted on the upper inside surface for the purpose of holding a removable metal rod 5 inches in length and 0.055 inch in diameter;

j) a second removable metal warp rod 5 inches in length and 0.055 inch in diameter being mounted through said screw eyes on said tailstock;

k) three wooden pegs, each approx. 2 inches in length and 5/32 inch in diameter, removably inserted into said holes in said headstock or tailstock to secure the two ends of the "warp thread" and the single end of the "weft thread".

4. The beading loom of claim 3 further comprising two circular rare earth magnets each measuring 3/8 inch in diameter and 1/8 inch thick mounted on the top surface of the rear cleat to securely store the warp rods when they are not in use.

5. The beading loom of claim 4 wherein said loom is adjustable in length from approximately 2 inches through approximately 12 inches by means of said rear vertical upright tailstock that slides on said wooden dowel guide rods and central threaded rod and is then locked into place through the use of said two wing nuts on the central threaded rod.

* * * * *